United States Patent [19]

Bosler

[11] Patent Number: 4,727,689

[45] Date of Patent: Mar. 1, 1988

[54] DETACHABLE RAIN GUTTER

[75] Inventor: Kenneth D. Bosler, Bensalem, Pa.

[73] Assignee: Kusan, Inc., Brentwood, Tenn.

[21] Appl. No.: 901,326

[22] Filed: Aug. 28, 1986

[51] Int. Cl.[4] ..... E04D 13/06

[52] U.S. Cl. ..... 52/12; 52/11; 52/16

[58] Field of Search ..... 52/12, 11, 16; 248/48.1, 48.2

[56] References Cited

U.S. PATENT DOCUMENTS

| | | | |
|---|---|---|---|
| 891,405 | 6/1908 | Cassens | 52/12 X |
| 2,583,422 | 1/1952 | Haddon | 52/12 |
| 2,674,961 | 4/1954 | Lake | 52/12 X |
| 2,988,226 | 6/1961 | Campbell | 52/12 X |
| 3,098,322 | 7/1963 | Greene | 52/11 |
| 3,341,158 | 9/1967 | Landis | 248/48.2 |
| 3,388,555 | 6/1968 | Foster | 52/12 X |
| 3,436,878 | 4/1969 | Singer | 248/48.2 X |
| 3,550,381 | 12/1970 | South | 52/11 |
| 4,631,875 | 12/1986 | Olson | 52/12 |

FOREIGN PATENT DOCUMENTS

| | | | |
|---|---|---|---|
| 1216292 | 12/1970 | United Kingdom | 52/12 |

*Primary Examiner*—Alfred C. Perham

*Attorney, Agent, or Firm*—James D. Hall; Thomas J. Dodd

[57] ABSTRACT

A rain gutter which is formed of a one-piece sheet of material and includes terminal flanges. A clip member secured to the building side wall includes a channel into which the gutter terminal flanges are restrictively fitted to suspend the gutter below the building roof. The gutter top wall includes openings to allow moisture to be drained, while preventing entry of debris which could clog the gutter and downspout.

6 Claims, 4 Drawing Figures

DETACHABLE RAIN GUTTER

BACKGROUND OF THE INVENTION

This invention relates to a rain gutter and will have application to a one-piece gutter trough and cover which is detachably secured to a roof attached mounting clip.

Heretofore, most rain gutters included open tops and were secured to a building by driving nails transversely through the gutter into the building to support. Some gutters have included a removable top cover piece which included openings for preventing entry of leaves and other debris into the gutter. Examples of such gutters are seen in U.S. Pat. Nos. 3,436,878; 3,950,951; 4,241,548; 4,411,110; and 4,447,994.

Other gutters have been constructed which are detachably secured to clips which are fastened under the roof shingles. Examples of such gutters are seen in U.S. Pat. Nos. 1,343,461; 3,098,322; 3,612,453; 3,809,347; and 4,195,452.

SUMMARY OF THE INVENTION

The rain gutter of this invention includes a one-piece gutter trough and cover and an elongated mounting clip. The clip is fastened to the building side wall and includes a channel member which restrictively accepts overlapping flanges of the gutter trough and cover. The cover of the gutter includes openings which prevent entry of leaves and other similar debris into the gutter which may clog the gutter and connected downspouts. Installation, maintenance, and replacement of the gutter is rapidly accomplished due to this construction.

Accordingly, it is an object of this invention to provide for a one-piece rain gutter trough and cover which may be detached from a building without removing any fasteners.

Another object of this invention is to provide for a one-piece rain gutter trough and cover which effectively prevents leaves and debris from clogging the downspouts.

Still another object of this invention is to provide for a rain gutter which is economical and essentially maintenance free.

Still another object of this invention is to provide for a rain gutter which is efficient and aesthetically appealing.

Other objects of this invention will become apparent upon a reading of the following description.

BRIEF DESCRIPTION OF THE DRAWINGS

A preferred embodiment of the invention has been depicted for purposes of illustration wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to thereby enable others skilled in the art to utilize the invention.

Figure 1:
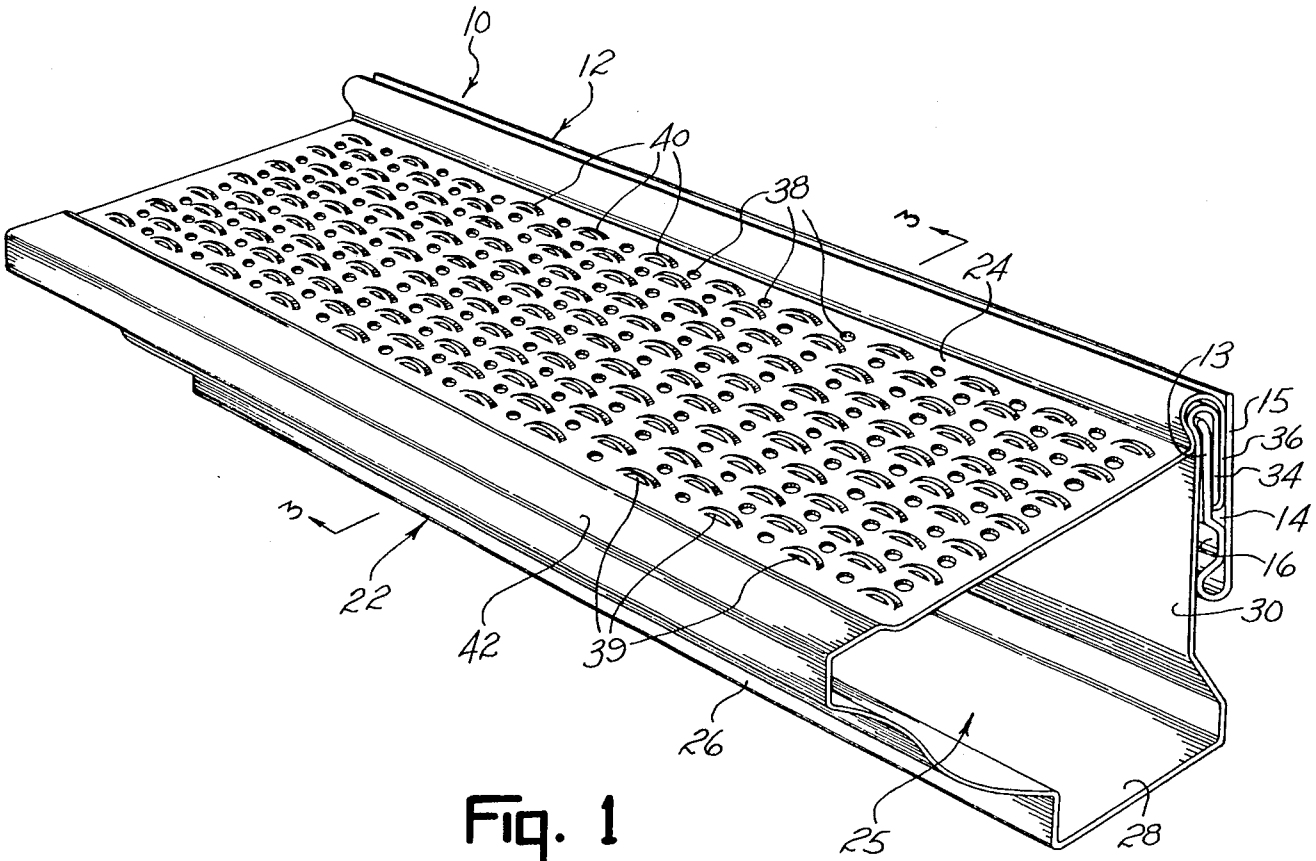
FIG. 1 is a perspective view of the rain gutter.
Figure 2:
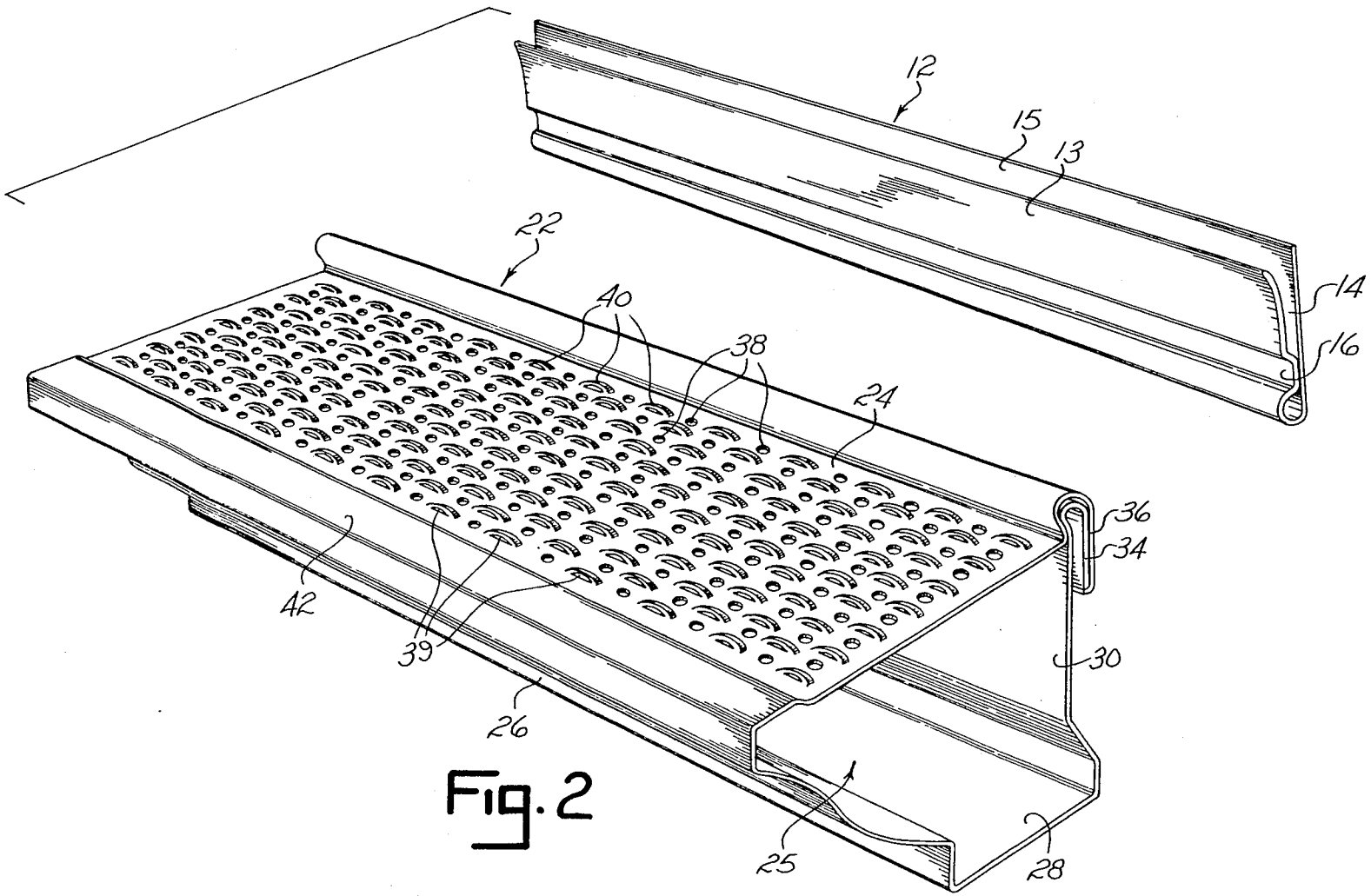
FIG. 2 is an exploded view of the gutter trough and clip.
Figure 3:
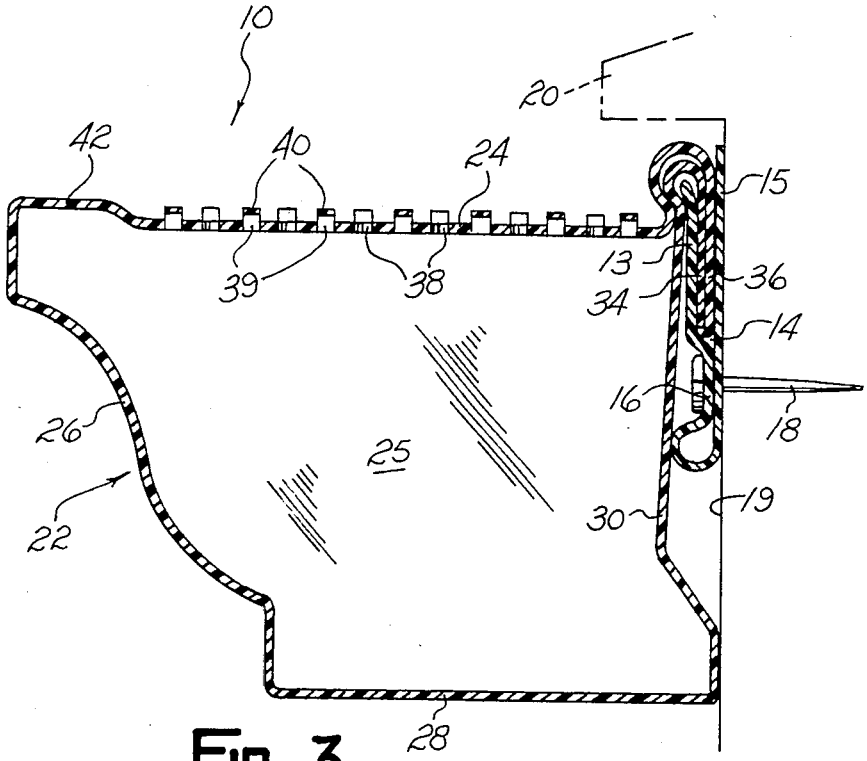
FIG. 3 is a sectional view of the gutter attached to the side of a house as taken along line 3—3 of FIG. 1.

The rain gutter 10 shown in the drawings includes a mounting clip 12 which is preferably formed of durable lightweight plastic or metal stripping. Clip 12, as shown in FIGS. 2–3, is generally U-shaped with the open end facing upwardly and includes side walls 13 and 15 to define a channel 14. Clip 12 may include a recessed portion 16 in its outer wall 13 through which a fastener 18 may be driven to secure the clip to a building facing board or side wall 19 below the roof 20.

Gutter 10 also includes a one piece gutter part 22 which has a cover 24 and a trough 25 defined by an outer wall 26, bottom wall 28 and the inner wall 30. A downturned mounting flange 34 extends from the upper edge of inner wall 30 and a downturned mounting flange 36 extends from the rear edge of cover 24. Flanges 34 and 36 overlap one another. Outer wall 26 may be shaped in profile as shown in FIG. 3 for aesthetic purposes. Cover 24 includes a plurality of openings (both round 38 and elongated 39) which are small enough to allow water and roof granules to enter trough 25 while preventing entry of leaves and other large debris. Cover openings 39 are formed by arched or raised protrusions or webs 40 which serve to direct the water and granules into openings 38 and 39 to prevent overflow. Additionally, cover 24 includes a raised portion 42 near its outer edge to further prevent water overflow.

Figure 4:
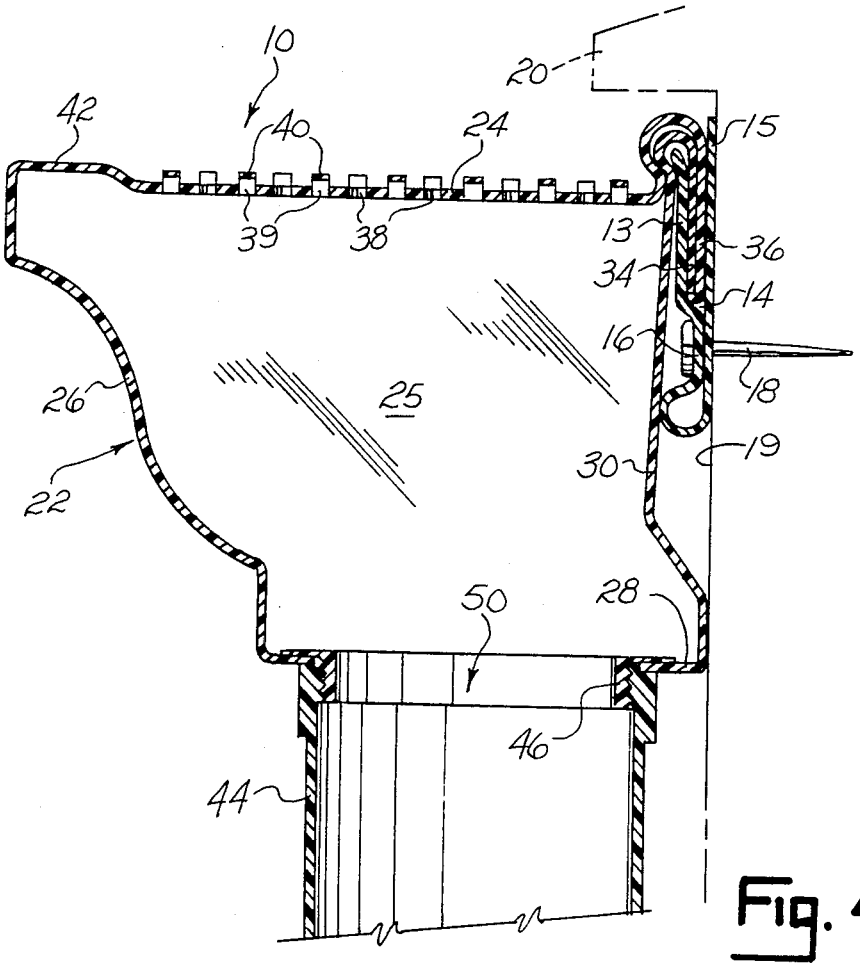
FIG. 4 is a sectional view of the gutter similar to FIG. 3 but showing the downspout connection.

Gutter 10 also includes one or more downspouts 44 (one shown in FIG. 4) which direct water from gutter part 22. A ring flange 46 which is fitted downwardly through an opening 50 in the trough's bottom wall 28 and threaded into downspout 44 to clamp and seal the downspout to the trough. The ends of trough 25 are closed by a suitable wall (not shown).

Gutter 10 is assembled as follows. Clip 12 is fastened to building side wall 19 by driving fasteners 18 through the clip at recess 16 along longitudinally spaced locations. Gutter part 22 is then attached to clip 12 by inserting overlapping flanges 34 and 36 into channel 14 (see FIG. 3) to secure the gutter part to the clip. Downspout 44 is then connected by ring flange 46 to complete the assembly.

It is understood that the invention is not limited to the above given details, but may be modified within the scope of the appended claims.

I claim:

1. A gutter for collecting falling moisture from a roof of a building, said gutter including a mounting member secured to said building, said mounting member including channel means for detachably accepting and securing said gutter, said gutter including a trough defined by an outer wall, an inner wall, and an integral bottom wall, said outer wall having an integrally formed upper portion spacedly overlying said bottom wall and terminating in a flange, said flange restrictively fitted within said mounting member channel means to provide securement means wherein said gutter is suspended adjacently below said building roof.

2. The gutter of claim 1 wherein said gutter inner wall upper portion includes a plurality of openings for allowing water to enter said trough, said openings of a sufficiently small diameter wherein leaves and other debris are prevented from entering said trough.

3. The gutter of claim 2 and an arched web extending over a said top wall opening, said web constituting means for directing moisture through said openings into said trough.

4. The gutter of claim 1 wherein said inner wall includes a downturned flange fitted restrictively within said mounting member channel means to provide further securement means for said gutter.

5. The gutter of claim 1 wherein said gutter outer wall is spaced from said building and includes a portion which extends upwardly of said gutter outer wall upper edge portion, said end wall portion constituting means for preventing overflow of moisture from said outer wall upper edge portion.

6. The gutter of claim 5 and outlet means connected to said gutter bottom wall for directing water away from said building, said outlet means including a downspout and bored connector, said downspout threadably connected to said bored connector.

* * * * *